US009171662B2

(12) United States Patent
Bockholt et al.

(10) Patent No.: US 9,171,662 B2
(45) Date of Patent: Oct. 27, 2015

(54) DRY TRANSFORMER HEATER

(71) Applicant: ABB TECHNOLOGY AG, Zürich (CH)

(72) Inventors: Marcos Bockholt, Paderborn (DE); Frank Cornelius, Olsberg (DE); Jens Tepper, Brilon (DE); Burak Esenlik, Paderborn (DE); Bhavesch Patel, Brilon (DE); Benjamin Weber, Winterberg (DE)

(73) Assignee: ABB TECHNOLOGY AG, Zurich (CH)

( * ) Notice: Subject to any disclaimer, the term of this patent is extended or adjusted under 35 U.S.C. 154(b) by 27 days.

(21) Appl. No.: 14/052,285

(22) Filed: Oct. 11, 2013

(65) Prior Publication Data

US 2014/0035709 A1 Feb. 6, 2014

Related U.S. Application Data

(63) Continuation of application No. PCT/EP2012/001088, filed on Mar. 10, 2012.

(30) Foreign Application Priority Data

Apr. 11, 2011 (EP) ..... 11003004

(51) Int. Cl.

| | |
|---|---|
| ***H01F 27/08*** | (2006.01) |
| ***H01F 27/10*** | (2006.01) |
| ***H01F 27/02*** | (2006.01) |
| ***H01F 27/00*** | (2006.01) |
| ***H01F 27/40*** | (2006.01) |

(52) U.S. Cl.

CPC ..... *H01F 27/008* (2013.01); *H01F 27/402* (2013.01)

(58) Field of Classification Search

CPC ..... H01F 27/22; H01F 27/10; H01F 27/14; H01F 27/402; H01F 27/08

USPC ..... 336/55, 57, 58, 59, 60, 61

See application file for complete search history.

(56) References Cited

U.S. PATENT DOCUMENTS

| | | | | |
|---|---|---|---|---|
| 2,041,286 | A * | 5/1936 | Erber et al. | 313/340 |
| 2,800,612 | A | 7/1957 | Riley | |
| 3,142,029 | A * | 7/1964 | Keen, Jr. et al. | 336/84 R |
| 3,147,744 | A * | 9/1964 | Percival | 122/33 |

(Continued)

FOREIGN PATENT DOCUMENTS

JP 2011-041437 A 2/2011

OTHER PUBLICATIONS

International Search Report (PCT/ISA/210) mailed on May 7, 2012, by the European Patent Office as the International Searching Authority for International Application No. PCT/EP2012/001088.

*Primary Examiner* — Elvin G Enad
*Assistant Examiner* — Kazi Hossain
(74) *Attorney, Agent, or Firm* — Buchanan Ingersoll & Rooney PC

(57) ABSTRACT

A dry-type transformer heater includes a closed housing, and at least one transformer winding arranged in the housing. The at least one transformer winding includes at least one corresponding winding conductor and a corresponding insulation layer surrounding the transformer winding, respectively. In addition to the respective winding conductor, at least one coil heating wire is provided in at least one of the insulation layer and on the surface of the insulation layer to input thermal power into the respective insulation layer.

20 Claims, 2 Drawing Sheets

(56) References Cited

U.S. PATENT DOCUMENTS 3,264,589 A * 8/1966 Dutton ..... 336/57
2004/0156158 A1* 8/2004 Walker et al. ..... 361/103
2009/0231075 A1* 9/2009 Moia ..... 336/61
2010/0038358 A1* 2/2010 Dingle et al. ..... 219/616

* cited by examiner

30

50

DRY TRANSFORMER HEATER

RELATED APPLICATIONS

This application claims priority as a continuation application under 35 U.S.C. §120 to PCT/EP2012/001088, which was filed as an International Application on Mar. 10, 2012 designating the U.S., and which claims priority to European Application 11003004.6 filed in Europe on Apr. 11, 2011. The entire contents of these applications are hereby incorporated by reference in their entireties.

FIELD

The present disclosure relates to a dry-type transformer heater.

BACKGROUND INFORMATION

It is generally known that dry-type transformers are used in power distribution systems to adapt the voltage levels of different system components. These have a power range of, for example, 100 kVA to some 10 MVA and are provided for rated voltages between, for example, a few kV to 110 kV. In contrast to oil-filled transformers, a liquid insulation medium is dispensed with here; rather, for example, the windings are surrounded by a solid insulation material, such as a fiber roving which is impregnated with resin and subsequently cured. In the case of a three-phase transformer, three windings of this type are then arranged around each limb of a transformer core. To dissipate the heat loss which occurs during operation, cooling ducts through the windings are necessary, for example, to a greater extent in the case of a hot working environment.

For certain applications, it is necessary to encapsulate dry-type transformers, to arrange them inside a closed housing. This can be the case, for example, for dry-type transformers which are arranged inside a very cold working environment or else on a ship or an oil-drilling platform and against the effects of salt-containing sea water. However, an encapsulation can occasionally be necessary merely because of the mechanical protective effect thereof. For example, in the event that an encapsulated transformer is subjected to frequent shutdowns depending on use, condensation can form inside the transformer housing since the transformer then cools down owing to the lack of heating effect of the winding losses. Even during permanent operation of an encapsulated transformer, condensation can be formed if the transformer is positioned in such a cold working environment that the winding losses do not lead to sufficient heating of the transformer or the housing thereof, with the result that the dew-point temperature is not exceeded. In this case, in the event of relatively long shutdowns, condensation collects on the interior surface of the housing or also on the surface of the windings.

In order to avoid condensation appearing inside a transformer housing, it is therefore usual, depending on requirements, to integrate space heaters in the housing, for example radiators. The radiators are often arranged, owing to a simplified arrangement, on either side of the transformer core on the base of the housing and have a heating region which is directed upward. As a result of this, the regions on either side of the transformer core are heated and the formation of condensation is avoided there. However, the transformer windings and the housing region thereabove are not directly covered by the heating region and so condensation can form there which can drip in a disadvantageous manner, for example from the upper housing region, onto the transformer windings located below.

SUMMARY

An exemplary embodiment of the present disclosure provides a dry-type transformer heater which includes a closed housing, and at least one transformer winding arranged in the housing. The at least one transformer winding respectively includes at least one winding conductor and an insulation layer surrounding the corresponding transformer winding, respectively. The exemplary dry-type transformer heater also includes at least one coil heating wire arranged at least one of in the corresponding insulation layer and on a surface of the corresponding insulation layer to input thermal power into the corresponding insulation layer.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
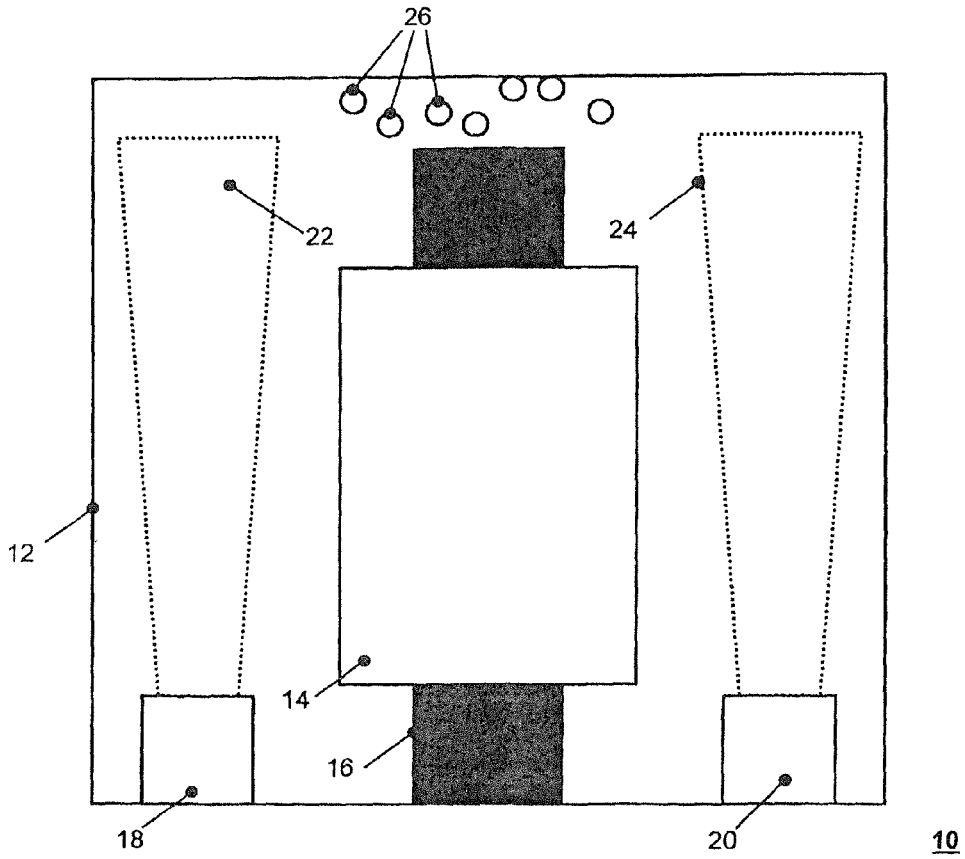
FIG. 1 shows a section through a known encapsulated dry-type transformer.

Exemplary embodiments of the present disclosure provide an improved dry-type transformer heater which avoids the drawbacks associated with known techniques as outlined above. According to an exemplary embodiment, the dry-type transformer heater of the present disclosure includes, in addition to the respective winding conductor, means for direct primary input of thermal power into the respective insulation layer.

The term "housing" in the scope of the present disclosure can mean both that the transformer winding is fixedly arranged in the housing and is movable therewith. However, it likewise means that a transformer winding or else the entire transformer is arranged in a closed room which does not directly form part of the transformer itself. This can be, for example, a closed room in the hull of a ship or else a room inside a building.

According to an exemplary embodiment of the present disclosure, by means of the direct primary input of thermal power into the insulation layer of the transformer winding, a local formation of condensation is avoided in this particularly critical region, because sufficient heating is ensured in a targeted manner there. However, according to an exemplary embodiment, the housing region above the transformer winding is also heated at the same time by the heat rising from the heated winding located below and so condensation dripping from above onto the transformer winding is avoided. The uncritical regions on either side of the transformer core or the transformer windings are only indirectly covered by the heating effect at the insulation layer, with the result that condensation might still form there. However, the dripping of the condensation from above is not damaging since this occurs in a region in which no windings are arranged.

According to an exemplary embodiment of the dry-type transformer heater, the means for direct primary input of thermal power into the insulation layer can be controlled independently of the electrical operation of the transformer winding. For a start, this makes it possible to operate the dry-type transformer heater both as a pure space heater and as an additional heater during operation of the transformer. The transformer windings are lossy, with the result that thermal power arises in the transformer windings during operation of the transformer. Depending on the external temperature and the power loss which arises, this can already be sufficient to avoid condensation; however, depending on requirements, additional thermal power of the dry-type transformer heater can also be necessary. By means of the controllability according to the present disclosure, the means for direct primary input of thermal power can be controlled in a targeted manner such that a sufficiently high temperature above the dew point is ensured.

According to a an exemplary embodiment of the dry-type transformer heater of the present disclosure, at least one temperature sensor is provided along with means to control the input thermal power such that the temperature of the insulation layer is above the respective dew point. Correspondingly, an open-loop and/or closed-loop control device can also be provided which predefines, as a function of the measured temperature, the thermal power which is inputted, according to a certain control characteristic. Exemplary arrangement points for one or even a plurality of temperature sensors include the interior wall region of the housing above the transformer core or the transformer windings, because condensation occurring there could drip in a disadvantageous manner onto the high-voltage windings and, in an extreme case, could lead, for example, to a short-circuit or other fault there.

According to an exemplary embodiment of the dry-type transformer heater of the present disclosure, at least one coil heating wire is arranged on the surface of the insulation layer as a means for direct primary input of thermal power. A coil heating wire is an electrical conductor which, owing to the internal resistance thereof, correspondingly heats up when an electrical current is passed through. Retrospective application to the insulation layer of a transformer winding is not critical. Depending on requirements, a suitable temperature-resistant and thermally conductive adhesive can also be used for this purpose. Owing to the insulation layer with which the transformer winding is surrounded, no insulation-related problems are to be expected in relation to the winding conductor of the transformer winding. In this way, a targeted input of heat to the surface of the high-voltage winding which is particularly critical in terms of condensation is enabled. According to an exemplary embodiment, the coil heating wire is arranged extensively over the surface, for example, with substantially parallel track spacing, with the result that the surface can be correspondingly homogeneously heated.

According to an exemplary embodiment of the dry-type transformer heater of the present disclosure, at least one coil heating wire is arranged within the insulation layer. The coil heating wire can then be inserted directly into the insulation during manufacture of the insulation, which, however, presents no problem in terms of production because appropriate winding machines are available anyway for manufacturing the transformer winding. An insulation layer mostly includes a multilayer wound fiber roving impregnated with resin, wherein the coil heating wires can then be inserted relatively close to the surface. In this way, firstly, the heating wires are protected by the insulation layer and, secondly, a more homogeneous distribution of thermal power generated depending on requirements is also ensured. Apart from that, the advantages of a coil heating wire arranged in this way correspond to the advantages of a heating wire arranged on the surface of the coil. Of course, a combination of both variant arrangements is also possible or else the arrangement of a plurality of coil heating wires around the same high-voltage winding.

According to an exemplary embodiment of the dry-type transformer heater of the present disclosure, at least one coil heating wire is laid in a meandrous fashion at least in sections. This enables particularly homogeneous heating of the corresponding section of the surface of the high-voltage winding or of its insulation layer with which it is surrounded.

According to an exemplary embodiment of the present disclosure, the distance between adjacent coil heating wire sections in certain regions of the insulation layer is reduced, wherein this applies both to coil heating wires within the insulation layer and outside the insulation layer. In this way, in surface regions in which a higher input of thermal power is useful, for example, at the connections of the high-voltage winding, a surface region having more densely laid coil heating wires is provided. In less critical regions, it is sufficient to lay the coil heating wires less densely.

According to an exemplary embodiment of the dry-type transformer heater of the present disclosure, at least one coil heating wire is electrically connected to a winding conductor of the transformer winding. For reasons of insulation, the arrangement of coil heating wires within the insulation layer is advantageous here. In this way, the coil heating wire is set at a defined potential and the risk of breakdowns of the insulation to the winding conductor is further reduced. However, care must be taken here that a voltage source which is provided for a flow of current through the coil heating wire must likewise also be set to the conductor potential. This is not always advantageous.

Therefore, according to an exemplary embodiment of the dry-type transformer heater of the present disclosure, an electrically short-circuited loop is formed by at least one coil heating wire, where the loop is arranged such that a voltage is induced therein during operation of the transformer winding. The loop then accordingly has a winding direction which corresponds at least in sections to that of the winding conductor of the transformer winding.

According to an exemplary embodiment of the present disclosure, the electrical resistance of the electrically short-circuited loop is variable by means of an electric component connected in series therewith. Such a component can be, for example, a switch by means of which the winding can be activated depending on requirements. However, it can also be a variable resistor or else a power electronic circuit which fulfills this purpose. The latter is distinguished, for example, by a good controllability.

According to an exemplary embodiment of the present disclosure, an electrical voltage source is provided to generate a flow of current through at least one heating wire. Depending on the control function to be implemented, this can be either a constant voltage source or else a variable voltage source.

According to an exemplary embodiment of the present disclosure, at least one UV radiator, which is directed toward the insulation layer, is provided. The UV radiator is arranged on an interior side wall of the housing, for example. When the UV rays encounter the insulation layer, they cause a direct input of heat into the layer. In the case of a three-phase transformer, at least one UV radiator of this type is required on each side of each of the three windings, that is to say at least six in total.

The advantages mentioned with respect to the dry-type transformer heater likewise also apply to an encapsulated dry-type transformer which includes a transformer core and a dry-type transformer heater, wherein in each case at least one transformer winding is arranged around one of, for example, three limbs of the transformer core. In an arrangement of a plurality of transformer windings, these are arranged together with the associated transformer core in a common housing, wherein a common heating system can also ultimately be provided. However, it is advantageous for each transformer winding or the insulation layer surrounding the respective winding to be provided with respective means for inputting thermal power.

Further advantageous features of the present disclosure will be described below with reference to exemplary embodiments illustrated in the drawings.

FIG. 1 shows a lateral section 10 through a known encapsulated dry-type transformer. A dry-type transformer is arranged in a common closed housing 12. The transformer core of the dry-type transformer is denoted with reference numeral 16, and a transformer winding of the dry-type transformer which is arranged over a limb of the transformer core 16 is denoted with reference numeral 14. Two heating elements 18, 20 are arranged on either side of the dry-type transformer at the base of the housing 12. The heating elements 18, 20 irradiate the lateral regions of the housing 12 in two respective radiation regions denoted by reference numerals 22 and 24 but do not irradiate the dry-type transformer located in the housing. Although the formation of condensation is avoided in the irradiated and, hence, heated lateral regions, an insufficient input of thermal power is achieved directly above the dry-type transformer, for example in the central upper region of the transformer housing, with the result that condensation is formed here, as indicated with reference numeral 26. This can drip onto the transformer located below in a disadvantageous manner and thus, for example, lead to short-circuits or to a malfunction of the dry-type transformer.

Figure 2:
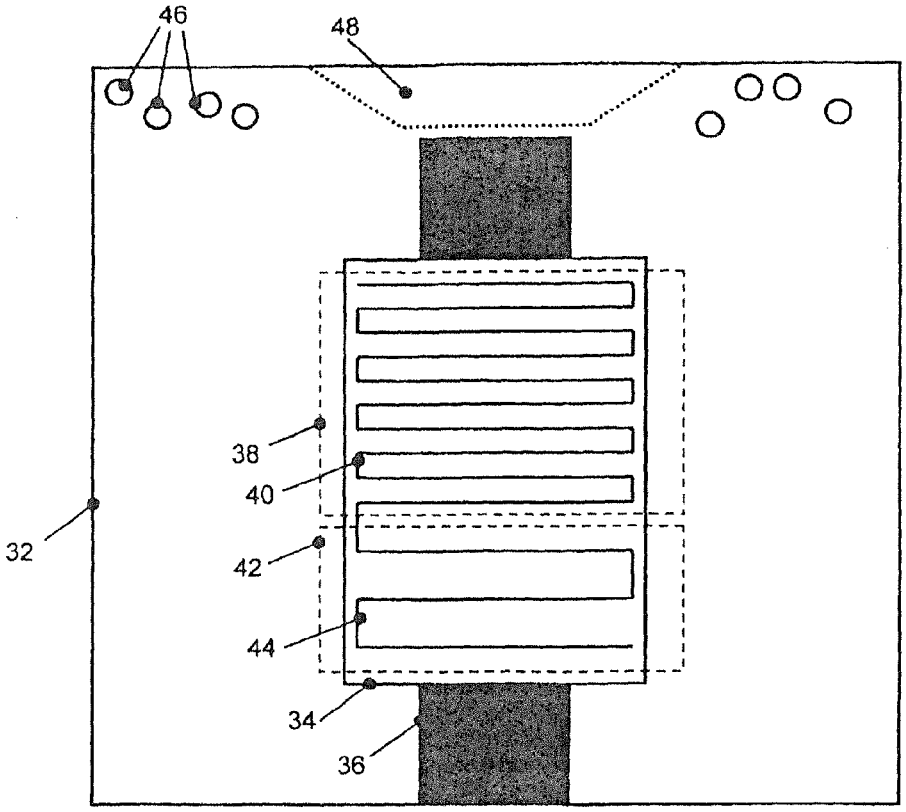
FIG. 2 shows a section through an encapsulated dry-type transformer according to an exemplary embodiment of the present disclosure.

FIG. 2 shows a lateral section 30 through an encapsulated dry-type transformer according to an exemplary embodiment of the present disclosure. A dry-type transformer having a transformer core 36 and a transformer winding 34 is shown in a housing 32, another two (not shown) transformer windings being arranged behind. Two regions 38 and 42 in which in each case a coil heating wire is arranged in a meandrous manner are indicated on the surface of the transformer winding 34. In the first region 38, a narrow meandrous shape 40 is provided, while another, less narrow meandrous shape 44 is provided in the second region 42. The input of thermal power per surface unit is thus correspondingly higher in the first region 38.

The heated transformer coil 34 outputs, predominantly by means of heated air rising at the outer surface of the insulation layer, a portion of the input thermal power to the roof part (e.g., top part in FIG. 2) of the transformer housing 32 located above the transformer. The roof part then likewise is heated as indicated by the radiation region with reference numeral 48. Therefore, for example, at the especially critical housing region above the transformer, such a high temperature is reached that its temperature is above the respective dew-point temperature. In the uncritical and unheated side regions inside the housing (e.g., to the regions of the housing not including the housing region above the transformer as shown in FIG. 2), the formation of condensation is indicated on the respective lid regions with reference numeral 46. This does not cause damage, however, because it drips into regions of the housing 32 where no transformer winding is arranged.

Figure 3:
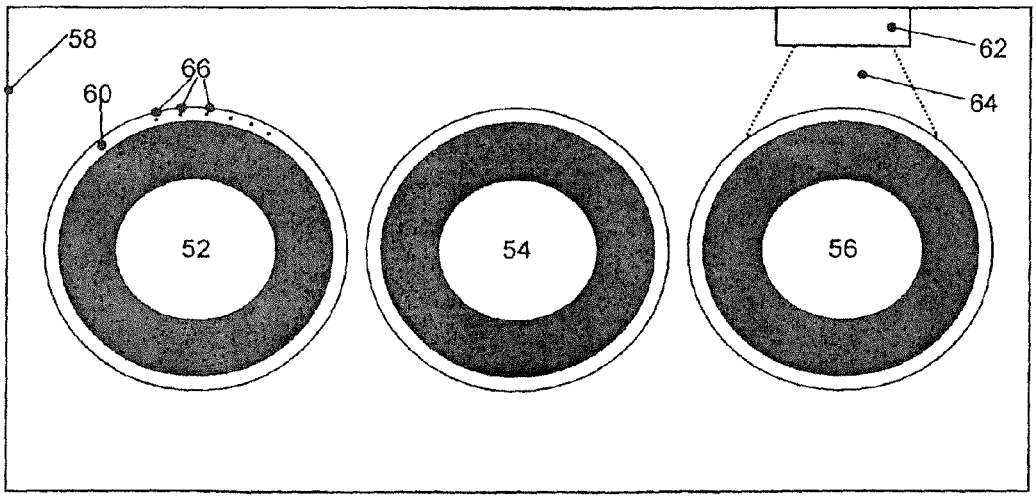
FIG. 3 shows a section through an encapsulated dry-type transformer according to an exemplary embodiment of the present disclosure.

FIG. 3 shows a section 50 through an encapsulated dry-type transformer in a plan view. Three hollow-cylindrical transformer windings 52, 54, 56 are arranged next to one another in a closed housing 58, wherein a corresponding transformer core is not shown for representational reasons. The transformer windings 52, 54, 56 are surrounded radially on the outside by a respective insulation layer 60. Within the insulation layer 60, a plurality of coil heating wires are denoted with reference numeral 66 and, in this example, are arranged along the axial extent of the respective transformer windings 52, 54, 56. Of course, an arrangement which is transverse thereto is also conceivable, for example if a short-circuited induction loop is to be formed. With this, it is possible, for example, to provide an input of thermal power into the insulation layer 60 during operation of the transformer without an additional voltage source.

The transformer winding with reference numeral 56 is irradiated, as denoted with reference numeral 64, laterally by an infrared heating element 62 in the manner indicated. In this way, a direct primary energy input into the insulation layer 60 is also possible.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

10 section through a first encapsulated dry-type transformer
12 first closed housing
14 first transformer winding
16 first transformer core
18 first heating element
20 second heating element
22 first radiation region
24 second radiation region
26 condensation above the transformer winding
30 section through a second encapsulated dry-type transformer
32 second closed housing
34 second transformer winding
36 second transformer core
38 region with first thermal power to be input
40 coil heating wire in first meandrous shape
42 region with second thermal power to be input
44 coil heating wire in second meandrous shape
46 condensation beside transformer winding
48 third radiation region
50 section through a third encapsulated transformer
52 third transformer winding
54 fourth transformer winding
56 fifth transformer winding
58 third closed housing
60 insulation layer
62 infrared heating element
64 fourth radiation region
66 coil heating wire

What is claimed is:

1. A dry-type transformer heater, comprising:

a closed housing;

at least one transformer winding arranged in the housing, the at least one transformer winding respectively including at least one winding conductor and an insulation layer surrounding the corresponding transformer winding, respectively; and at least one coil heating wire arranged at least one of in the corresponding insulation layer and on a surface of the corresponding insulation layer to input thermal power into the corresponding insulation layer.

2. The dry-type transformer heater as claimed in claim 1, wherein the at least one coil heating wire respectively includes means for direct primary input of the thermal power into the insulation layer, wherein the means for direct primary input of the thermal power is controllable independent of an electrical operation of the transformer winding.

3. The dry-type transformer heater as claimed in claim 2, comprising:

at least one temperature sensor, wherein the means for direct primary input of the thermal power controls an input thermal power such that a temperature of the insulation layer is above a respective dew point.

4. The dry-type transformer heater as claimed in claim 1, wherein the at least one coil heating wire is laid in a meandrous fashion at least in sections.

5. The dry-type transformer heater as claimed in claim 1, wherein a distance between adjacent coil heating wire sections in certain regions of the insulation layer is reduced.

6. The dry-type transformer heater as claimed in claim 1, wherein the at least one coil heating wire is electrically connected to the corresponding winding conductor of the transformer winding.

7. The dry-type transformer heater as claimed in claim 1, wherein the at least one coil heating wire forms an electrically short-circuited loop, the loop being arranged such that a voltage is induced therein during operation of the transformer winding.

8. The dry-type transformer heater as claimed in claim 7, wherein an electrical resistance of the electrically short-circuited loop is variable by means of an electric component connected in series with the electrically short-circuited loop.

9. The dry-type transformer heater as claim 1, comprising:

an electrical voltage source configured to generate a flow of current through the at least one heating wire.

10. An encapsulated dry-type transformer, comprising:

a transformer core; and a dry-type transformer heater as claimed in claim 1, wherein the at least one transformer winding is respectively arranged around one of three limbs of the transformer core.

11. The dry-type transformer heater as claimed in claim 3, wherein the at least one coil heating wire is laid in a meandrous fashion at least in sections.

12. The dry-type transformer heater as claimed in claim 11, wherein a distance between adjacent coil heating wire sections in certain regions of the insulation layer is reduced.

13. An encapsulated dry-type transformer, comprising:

a transformer core; and a dry-type transformer heater as claimed in claim 12, wherein the at least one transformer winding is respectively arranged around one of three limbs of the transformer core.

14. The dry-type transformer heater as claimed in claim 3, wherein the at least one coil heating wire is electrically connected to the corresponding winding conductor of the transformer winding.

15. An encapsulated dry-type transformer, comprising:

a transformer core; and a dry-type transformer heater as claimed in claim 14, wherein the at least one transformer winding is respectively arranged around one of three limbs of the transformer core.

16. The dry-type transformer heater as claimed in claim 3, wherein the at least one coil heating wire forms an electrically short-circuited loop, the loop being arranged such that a voltage is induced therein during operation of the transformer winding.

17. The dry-type transformer heater as claimed in claim 16, wherein an electrical resistance of the electrically short-circuited loop is variable by means of an electric component connected in series with the electrically short-circuited loop.

18. An encapsulated dry-type transformer, comprising:

a transformer core; and a dry-type transformer heater as claimed in claim 17, wherein the at least one transformer winding is respectively arranged around one of three limbs of the transformer core.

19. The dry-type transformer heater as claim 2, comprising:

an electrical voltage source configured to generate a flow of current through the at least one heating wire.

20. An encapsulated dry-type transformer, comprising:

a transformer core; and a dry-type transformer heater as claimed in claim 19, wherein the at least one transformer winding is respectively arranged around one of three limbs of the transformer core.

* * * * *